US005131252A

United States Patent [19]

Turley et al.

[11] Patent Number: 5,131,252

[45] Date of Patent: Jul. 21, 1992

[54] APPARATUS AND METHOD FOR COLD ROLLING OF METAL STRIP

[75] Inventors: John W. Turley, New Haven County; Michael G. Sendzimir, Litchfield County, both of Conn.

[73] Assignee: T. Sendzimir, Inc., Waterbury, Conn.

[21] Appl. No.: 649,174

[22] Filed: Feb. 4, 1991

Related U.S. Application Data

[63] Continuation of Ser. No. 237,447, Aug. 29, 1988, abandoned.

[51] Int. Cl.[5] ..... B21B 27/02; B21B 31/18

[52] U.S. Cl. ..... 72/242.4; 72/247; 72/252.5; 72/366.2

[58] Field of Search ..... 72/199, 200, 201, 234, 72/252.5, 366.2, 242.4, 247

[56] References Cited

U.S. PATENT DOCUMENTS

| | | | |
|---|---|---|---|
| 2,732,591 | 1/1956 | Whittum | 72/366 |
| 3,533,262 | 10/1970 | Sendzimir | 72/234 |
| 4,440,012 | 4/1984 | Feldmann et al. | 72/366 |
| 4,730,475 | 3/1988 | Ginzburg | 72/366 |

FOREIGN PATENT DOCUMENTS

| | | | |
|---|---|---|---|
| 0276705 | 12/1986 | Japan | 72/234 |
| 176603 | 4/1987 | Japan | 72/252.5 |
| 1297957 | 3/1987 | U.S.S.R. | 72/366 |

*Primary Examiner*—Lowell A. Larson
*Assistant Examiner*—Thomas C. Schoeffler
*Attorney, Agent, or Firm*—Frost & Jacobs

[57] ABSTRACT

Means and method for cold rolling metal strip characterized by edge drop. The invention contemplates the use in a cold rolling mill of at least one roll having a base profile provided with a flared component adjacent to at least one end of the roll. The base profile can be crowned, cylindrical, partly crowned and partly cylindrical, or partly cylindrical and partly tapered. The roll or rolls can be work rolls, intermediate rolls or the like. Rolls provided with a flared component at one end only can be arranged in skew-symmetry and shifted independently in an axial direction to adjust the work roll gap profile. The roll or rolls of the present invention and the method employing them achieve uniform elongation of the metal strip, minimizing quarter buckle. The at least one flared portion can be truncated at a point adjacent to the edge of the strip to be rolled.

17 Claims, 7 Drawing Sheets

APPARATUS AND METHOD FOR COLD ROLLING OF METAL STRIP

This is a continuation of application Ser. No. 07/237,447, filed Aug. 29, 1988 now abandoned.

TECHNICAL FIELD

This invention relates to rolls for metal rolling mills and more particularly to the manufacture or shaping of such rolls so that they may be used in a rolling mill to produce strip of good flatness, free of quarter buckle, from incoming strip having edge drop.

BACKGROUND ART

When metal strip is passed between the work rolls of a cold rolling mill, it is essential that the strip being delivered by the mill has the same profile as the strip entering the mill, the strip profile being defined as the variation in thickness across the width of the strip, expressed as a percentage of the thickness at the middle of the strip. This can only be achieved by giving every element of strip across the width of the strip the same percentage reduction, and the same elongation as every other element. To satisfy this condition, the profile of the roll gap during rolling (i.e. the roll gap profile when the rolling mill structure is deflected under the action of the roll separating forces which occur during rolling) must be identical to the desired profile of the strip being delivered, this profile being identical to that of the incoming strip.

Virtually all rolling mills have the characteristic that, under the action of the roll separating force, the rolls deflect away from the strip a greater amount at the middle of the strip than at the strip edges. As a result, when rolling strip having a uniform profile with cylindrical mill rolls, the profile of the roll gap during rolling, and hence of the strip being delivered, is convex (as shown in FIG. 1). In this case, the percentage reduction and elongation are greater at the strip edges, and the issuing strip has the flatness defect known as "long edge" or "wavy edge".

To overcome this effect, as is well known in the art, some or all of the rolls in a rolling mill are provided with a convex profile or "crown". This crown is usually produced by grinding the roll(s) in a roll grinding machine equipped with a crowning attachment. Such crowning attachments usually enable profiles only of parabolic or similar forms to be achieved. For small diameter Sendzimir mill work rolls, the crown can also be produced by bending the work roll in the grinding machine (using a system of steady rests) and grinding the bent roll as it rotates in the machine.

As shown in FIGS. 2*a* and 2*b*, when either one or two crowned rolls are used in the mill, it is possible to achieve uniform profile of the roll gap, and hence of the strip being delivered. In this case, if the profile of the incoming strip is uniform, the flatness of the issuing strip will be perfect.

In the case of FIG. 2*b* where one crowned and one uncrowned roll are used, it can be seen that the strip must flex laterally, but apart from this flexure, the strip has the same profile as the strip in FIG. 2*a*, where two crowned rolls are used. Since the strip is relatively flexible in the transverse direction, this causes no problems, and since it is often very convenient to grind a crown in one work roll only, rolling with one crowned and one uncrowned roll is very well known in the art.

When rolling with high separating forces large crowns are needed. When rolling with lower separating forces smaller crowns are needed, since the roll deflection is smaller at the smaller separating force. In theory, any one particular crown is only correct at one value of separating force, while in practice, it would be satisfactory for a small range of separating force. To give more flexibility, and avoid the need for frequent roll changes, when the roll separating force levels change (as, for example, when changing from rolling a thick, hard alloy to rolling a thin soft alloy), many rolling mills are provided with profiling controls. These fall into four main classes. These are roll bending controls (class 1), axial shifting controls (class 2), roll crossing controls (class 3) and thermal profiling controls (class 4).

It should be noted that all of these controls have the ability to control the strip thickness at the edge of the strip relative to the thickness at the middle of the strip. However, with the possible exception of thermal profiling, none of these can control the strip thickness at the quarter bands (i.e. those regions of the strip lying anywhere between the strip middle and the strip edges) independently of the thickness at the edge of the strip. For example, with roll bending controls, operating the controls to bend the roll ends away from the strip, as shown in FIG. 3, makes the strip edges thicker relative to the middle, but also makes the quarter bands thicker. Operating the controls to bend the roll ends towards the strip, as shown in FIG. 4, makes the strip edges thinner, but also makes the quarter bands thinner relative to the middle of the strip.

One of the more common types of flatness defect appearing on strip rolled by cold rolling mills is quarter buckle, a condition where the strip thickness at the quarter bands has been reduced too much, and the material at the quarter bands has been elongated too much relative to the material at middle and edges of the strip. Usually in strip having a flatness defect of the quarter buckle variety, elongation at the strip middle and the edges is similar, so neither center buckles (caused by excessive elongation at strip middle) or edge waves (caused by excessive elongation at strip edges) can be seen on the strip. Clearly strip having a flatness defect of the quarter buckle variety cannot have its flatness corrected by the prior art controls of classes 1, 2 and 3. Some correction of quarter buckle defect can be achieved on four high rolling mills rolling soft material such as aluminum using thermal profiling by means of modulation of coolant spray distribution, a class 4 profiling control, but such methods are ineffective or have very limited range when rolling harder metals, or when using cluster mills.

One object of the present invention is to provide means and a method for cold rolling metal strip which will inherently produce strip with much less quarter-buckle than prior art methods. The invention contemplates novel profiles for one, some or all of the rolls in a cold rolling mill.

A further object of the invention is to provide means and a method for cold rolling metal strip which takes into account the actual profile of strip being supplied to the mill, and determines the optimum profile or profiles of rolls in the mill accordingly.

Still another object of the invention is to provide a method of controlling the profile of the gap between the work rolls, and thus the profile of the issuing strip, so that the thickness of the strip in the area of the quarter bands can be controlled independently of the thickness of the strip at middle and edges.

It is known in the art that strip rolled on a hot rolling mill is characterized by a thinning of the strip in the area of the strip edges. This thinning is known as "feather", "edge drop" or as "edge droop" and can be expressed as a percentage of the gauge at the middle of the strip. It is also known that strip produced on a cold rolling mill, at heavy gauges, also develops edge drop as rolling proceeds. For example, copper and brass, which are frequently continuously cast at about ¾ inch thickness and about 25 inches wide, and are subsequently machined to a virtually uniform profile at about a ⅝ inch thickness, will commonly develop an edge drop of about 3% when cold rolled down to ⅛ inch thickness on a cold breakdown mill.

A typical cross section of a strip 20 produced by a hot rolling mill or a heavy gauge breakdown mill is shown in FIG. 5, with the strip profile indicated at 21. It can be seen from FIG. 5 that the strip thickness over the central 75% to 85% of the width exhibits a smooth and minor drop-off from the middle to the edges of this zone, i.e. it is very slightly crowned. For the last 5% to 10% of the strip width, the thickness drops off very rapidly towards each edge.

It is believed that the edge drop phenomenon is due to lateral sidespread of the strip in the hot mill or cold breakdown mill roll bite. For the central 75% to 85% or so of the width (depending upon thickness and width of the strip) the material in the roll bite is constrained by friction between the strip and the rolls, to elongate in the direction of rolling only. The material in the roll bite close to the strip edges, however, is free to spread sideways (i.e. in the direction of the roll axes) to some extent, as well as elongating in direction of rolling. The result of this freedom is that (a) the strip is thinner at the edges, because each element of strip close to the edges is made wider, as well as longer, as it passes through the roll bite and (b) the strip at the edges is a little shorter than the strip at the middle. It is possible to show the widening effect by measuring strip width before and after hot rolling. The edge shortening effect can be demonstrated by passing the strip under tension over a deflector roll. It will be seen that the strip edges "take a short cut" i.e. they hug the roll tightly and will even cut into the roll, whereas the middle of the strip (depending upon strip thickness and tension) may not even touch the roll.

FIG. 6 shows what happens when attempts are made to roll the strip 20 with a rolling mill having prior art roll profiles, of simple crowned form 22, as shown in FIG. 5. It is assumed that the mill profile is adjusted by selecting the correct theoretical crown, so that the elongation at the strip edge is the same as that at the strip middle. Because the strip is thinner at the edges, the roll gap must be given a convex profile 22*a*, as shown in FIG. 6, the curve 22*a* representing the deflected form of the roll profile 22 of FIG. 5. It will be understood that in FIG. 6 the profile 22*a* of the rolls in deflected condition (by virtue of the roll separating forces), the roll gap profile, and the profile of the exiting strip 20 are all the same.

By comparing FIG. 6, which shows the roll gap or strip profile 22*a* of the strip leaving the rolling mill, with FIG. 5, which shows the profile 21 of the strip entering the rolling mill, it can be seen that the profiles are different.

Note that, in the drawings, profile 22*a* of FIGS. 6 and 7 is the deflected form of the profile 22 of the rolls of FIG. 5. FIG. 7 shows the desired strip exit profile 21, (to achieve good strip flatness) which is identical in form to the incoming strip profile 21 of FIG. 5, superimposed upon the actual profile 22*a* of strip produced by the mill with prior art roll profiles. It can be seen from FIG. 7 that the strip in the area of the quarter bands has been made thinner than the ideal thickness indicated by the desired strip exit profile. The areas 23 of the strip section represent the difference between the ideal strip profile 21 and the actual strip profile 22*a*, and are a measure of the profile error. This "over-rolling" in the area of the quarter bands results in higher elongation in the area of the quarter bands than in the rest of the strip. This, in turn, causes the strip in the area of the quarter bands to buckle and produce the flatness defect known as "quarter buckle".

To achieve the desired strip exit profile 21, prior art rolls would have to bend very sharply close to the strip edges, as shown in FIG. 7. In practice they do not bend, firstly because of their flexural stiffness and secondly because there are no forces developing which could cause a sharp bend at the ends without causing too much bend at the middle of the rolls. Thus the "over-rolling" of the quarter bands is very commonly seen on all types of cold rolling mills, including those with large (and therefore flexurally stiff) work rolls and those with small (and therefore flexurally soft) work rolls.

DISCLOSURE OF THE INVENTION

According to the invention, means and a method are provided for cold rolling metal strip, characterized by edge drop, in such a way that uniform elongation is achieved throughout the width of the strip and quarter buckle is minimized. This is accomplished by providing one or more of the rolls in a cold rolling mill with a flared profile component close to one or both of its ends and in a location just inside the edge of the strip to be rolled. The at least one flared profile component increases the diameter of the roll at its respective end relative to its base profile. The flared component can be concave or conical in configuration. The flared component creates a concavity, hollow or a point of inflection in the roll surface profile where it blends with the base profile of the roll.

In one embodiment of the invention a pair of work rolls are provided, each having a base profile which forms a central convex or crowned portion covering most of the width of the strip, and shorter flared portions close to each end of the roll increasing the diameter relative to the base profile at the roll ends.

In another embodiment, a pair of work rolls are provided, wherein one work roll is conventially crowned and the other work roll is provided with a cylindrical base profile and flared components close to its ends.

The present invention also contemplates a skew-symmetrical embodiment wherein two work rolls are provided, each having a longitudinal half of cylindrical profile and a longitudinal half of crowned profile with a flared component close to its end.

Another skew-symmetrical arrangement provides a pair of work rolls, each of which is characterized by a crowned longitudinal half and a cylindrical longitudinal half with a flared component close to its end.

A conventional 6-high mill can be provided with cylindrical or crowned work and back-up rolls and axially shiftable intermediate rolls skew-symmetrically arranged. Each intermediate roll has a base profile comprising a main cylindrical portion and a tapered portion of linear (conical) or convex form. The tapered portion of each intermediate roll terminates in a flared component.

A conventional 20-high cluster mill is provided with slightly crowned or cylindrical work rolls, first intermediate rolls, second intermediate rolls and back-up rolls. According to the present invention each of the first intermediate rolls is capable of independent axial adjustment. The upper first intermediate rolls are profiled to have a main cylindrical portion. One terminates in a linear or convex tapered portion at one end. The other teminates in a flared component at the same end. The lower first intermediate rolls are similarly profiled and skew-symmetrically arranged.

In all of the embodiments, that part of the flared portions adjacent to the strip edges can be truncated to reduce the amount of roll grinding required, and (for all rolls except 2-high mill rolls) to reduce undesirable contact between the roll and its support roll.

DETAILED DESCRIPTION OF THE INVENTION

Figure 7:
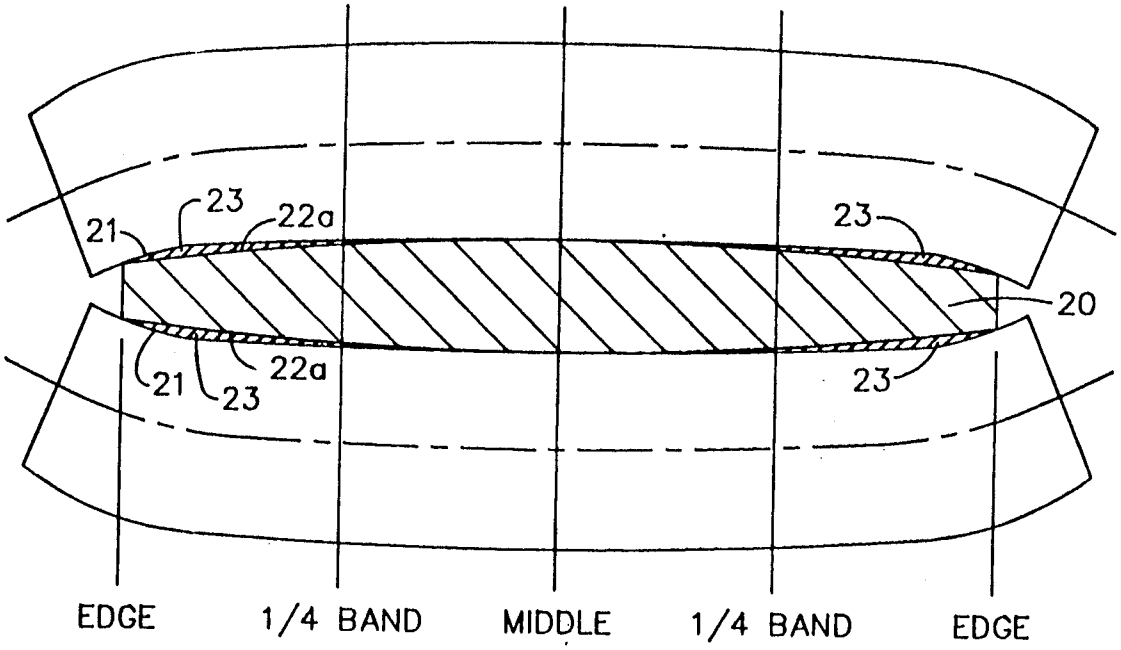
FIG. 7 (PRIOR ART)
FIG. 7 is a simplified elevational view, partly in cross section, of prior art rolls in hypothetical deflected condition, comparing the roll profile with the desired ideal profile of the strip.
Figure 8:
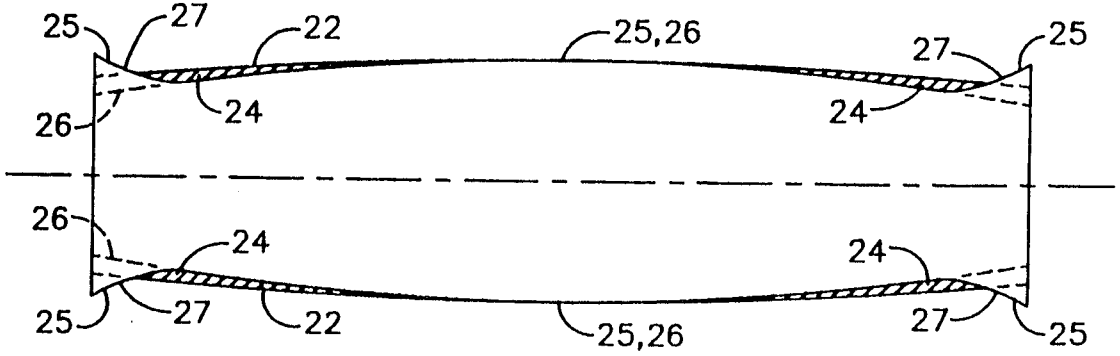
FIG. 8 is a simplified elevational view of a work roll according to the present invention.

FIG. 8 shows a work roll according to one embodiment of the present invention. The finished work roll profile 25 is made thinner than profile 22 of the prior art roll of FIG. 5 in the areas 24 which correspond in location, height and width to areas 23 of FIG. 7.

Figure 10:
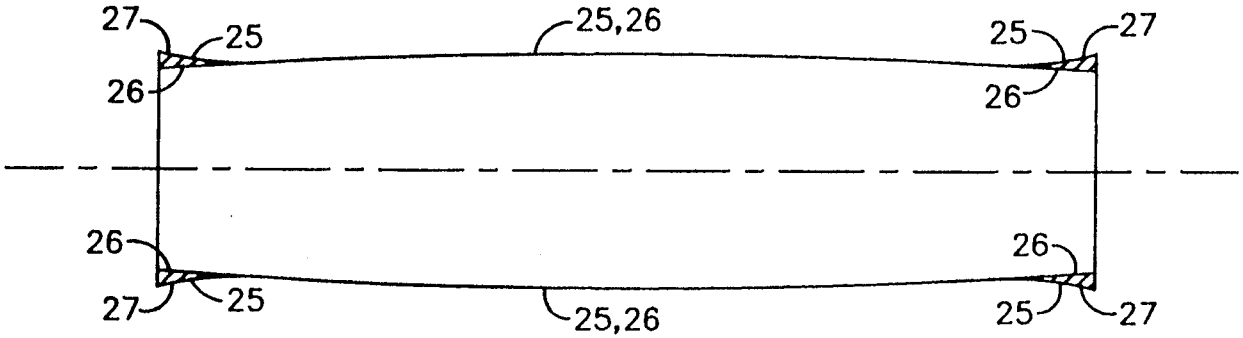
FIG. 10 is a simplified elevational view of a work roll according to the present invention similar to that of FIG. 8.

Work roll profile 25 can also be formed as shown in FIGS. 8 & 10 by constructing a base profile 26, of the same form as prior art profile 22, but of greater height and by making this profile thicker in the area of the strip edges by forming flared portions 27.

Thus, this new roll profile 25 is characterized by and comprises a base profile 26, which forms a central convex portion which covers most of the width of the strip to be rolled by the roll, and a shorter flared portion 27 at each end of the roll, which gives an increased diameter at the roll ends relative to the base profile 26, and forms a concavity, hollow or point of inflection in the roll surface profile where it blends with the central convex portion. This finished profile 25 is coincident with base profile 26 over the central portion of the roll, and is coincident with flared portions 27 at the ends of the roll.

Figure 5:
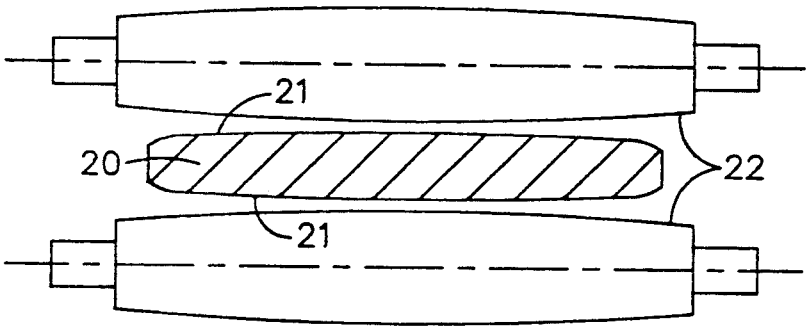
FIG. 5 is a simplified elevational view, partly in cross section, of a pair of prior art crowned rolls, and the profile of an incoming strip characterized by edge drop.
Figure 6:
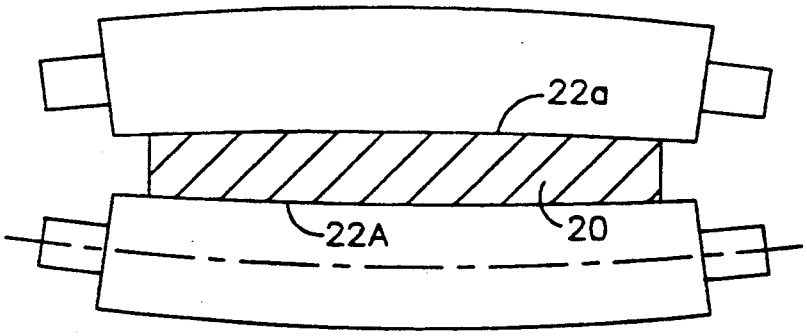
FIG. 6 is a simplified elevational view, partly in cross section, of the rolls and strip of FIG. 5, illustrating the deflection of the rolls and the profile of the strip.
Figure 9:
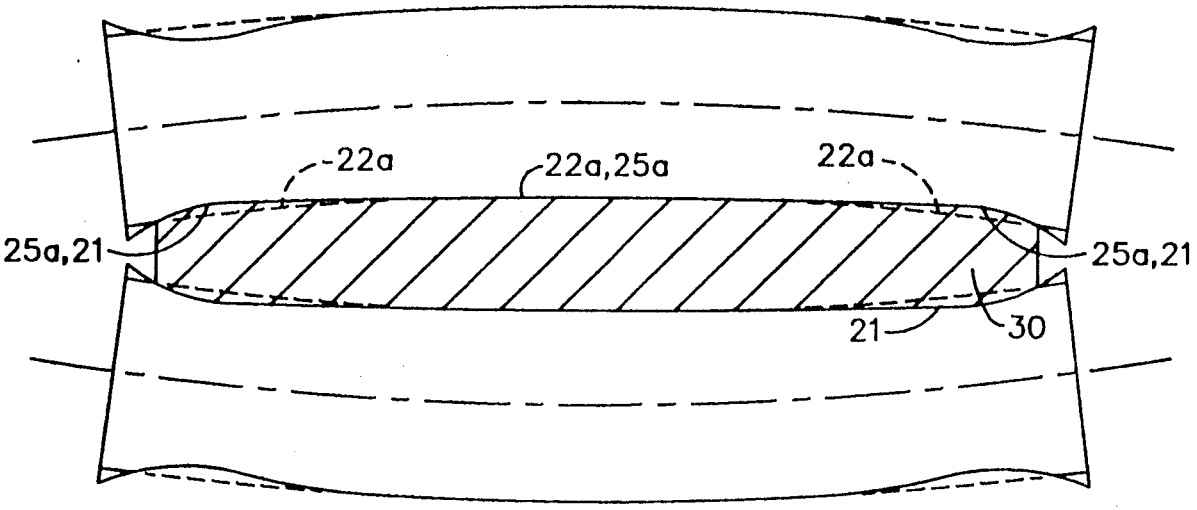
FIG. 9 is a simplified elevational view, partly in cross section, illustrating a pair of rolls of the type shown in FIG. 8 in deflected condition and the profile of the strip.

In FIG. 9, the deflected form of the roll of FIGS. 8 and 10, when rolling strip of the same profile as FIGS. 5 and 7, can be seen. The deflected form of roll profile 25 is shown in FIG. 9 at 25*a*. The deflected roll profile 25*a* will form the ideal strip profile 21. For comparison, the prior art deflected profile 22*a* is also shown in FIG. 9 in broken lines. Clearly the roll of the present invention is able to roll incoming strip having edge drop to the desired exit profile, and can thus roll the strip to optimum flatness.

Figure 11:
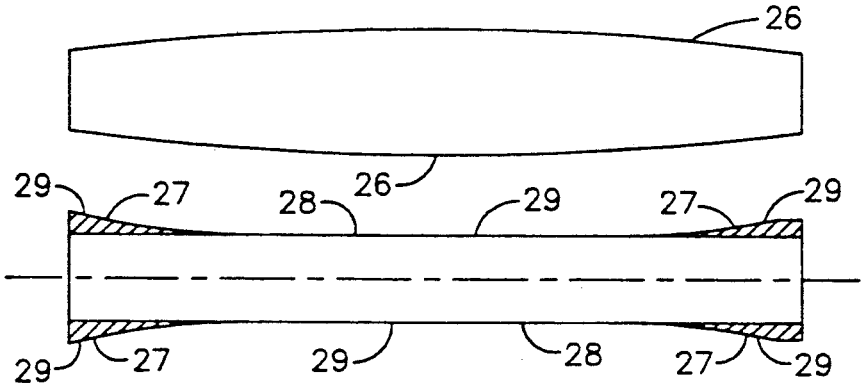
FIG. 11 is a simplified elevational view of a pair of work rolls according to another embodiment of the present invention.

The same beneficial effect as that produced by the rolls of FIG. 9 can also be produced by a pair of rolls in combination, one having a finished profile equivalent to the base profile 26, and the second having a finished profile 29, as shown in FIG. 11. Finished profile 29 comprises a base profile 28 which is flat (cylindrical), and which is thickened by flares 27 in the areas of the strip edges, the flares 27 being of the same form and magnitude as the flares 27 in FIGS. 8 and 10.

It should be noted that the roll profile 29, shown in FIG. 11, may be either complete as shown on the left, or truncated as shown on the right, with the original cylindrical roll form extending from the truncation point to the right end of the roll. Since the portions of the roll which will be well outside the strip edges do not affect the strip profile, this truncation has no harmful effect, but has the advantage that the amount of material which must be removed from the roll surface by grinding an initially cylindrical roll to produce this roll profile 29 is less if the profile is truncated. The narrower the strip to be rolled the greater the truncation, i.e. the shorter the active part of the profile 29 needs to be, so the smaller the amount of roll grinding required to produce the truncated profile rather than the full profile.

Truncated profiles can be used for all the rolls of the present invention without departing from the spirit of the invention. Portions of the roll profile which lie outside the truncation points may be cylindrical or any other profile (usually depending upon the profile previously ground in the roll).

Figure 12:
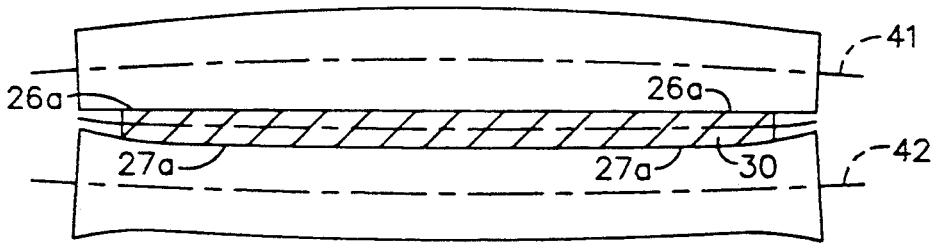
FIG. 12 is a simplified elevational view, partly in cross section, illustrating the rolls of FIG. 11 in deflected condition and the resulting strip profile.

FIG. 12 shows the deflected forms 26*a* and 29*a* of the roll profiles 26 and 29 respectively of FIG. 11, when rolling strip of the desired profile of FIGS. 5 and 7. It can be seen that the profile of the issuing strip in this case, apart from the unimportant transverse flexure thereof, is the same as the ideal profile 21 produced by the example of FIG. 9.

The examples given above are for two-high cold rolling mills. For 4-high mills the crowns can be provided on work rolls or backup rolls, or both. For 6-high mills and multi-roll mills the crowns can be provided on any or all of work rolls, intermediate rolls and back-up rolls.

Figure 1:
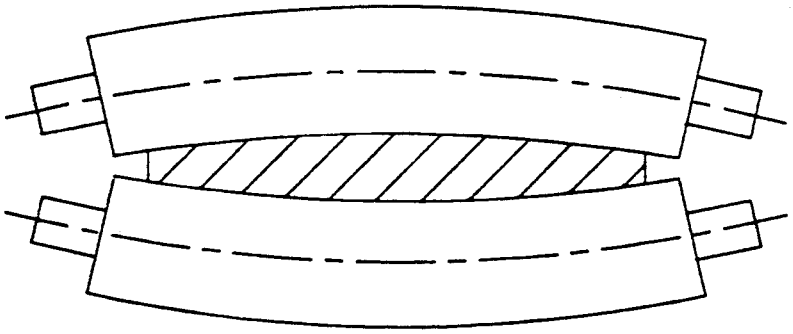
FIG. 1 (PRIOR ART)
FIG. 1 is a simplified elevational view, partly in cross section, illustrating the deflection of prior art cylindrical rolls and the resulting strip profile in a prior art rolling mill.
Figure 2A:
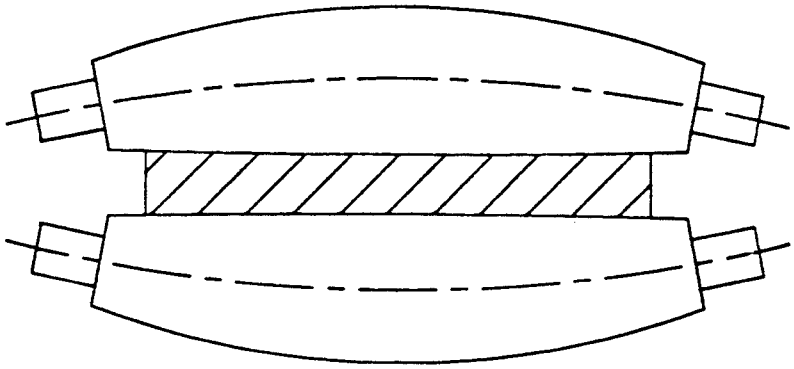
FIG. 2a (PRIOR ART)
FIG. 2*a* is a simplified elevational view, partly in cross section, illustrating the deflection of prior art crowned rolls, and the resulting strip profile in a prior art rolling mill where the incoming strip profile is uniform.
Figure 2B:
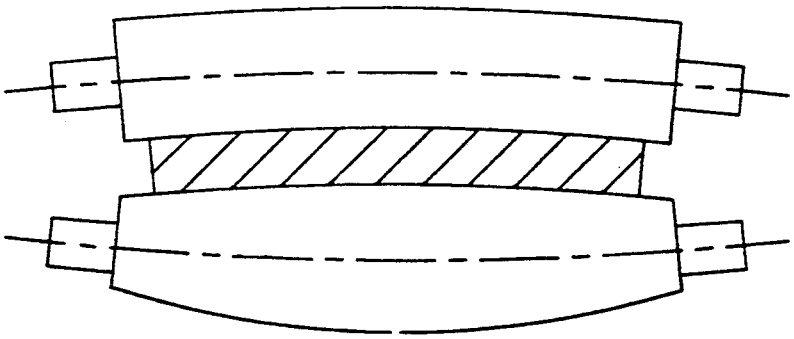
FIG. 2b (PRIOR ART)
FIG. 2*b* is a simplified elevational view, partly in cross section, illustrating the deflection of a prior art crowned roll and a prior art cylindrical roll, and the resulting strip profile in a prior art rolling mill where the incoming strip profile is uniform.
Figure 3:
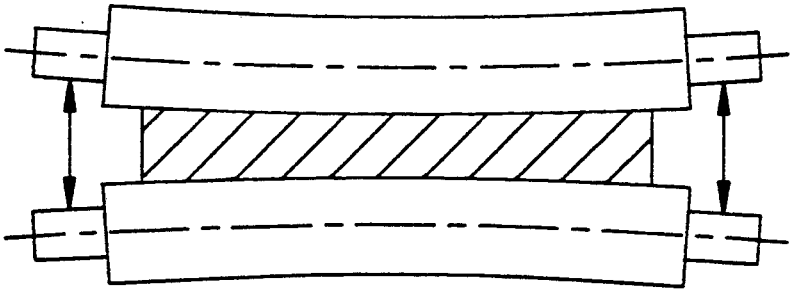
FIG. 3 (PRIOR ART)
FIG. 3 is a simplified elevational view, partly in cross section, illustrating a pair of prior art crowned rolls utilizing roll bending controls to bend the roll ends away from the strip, and the resulting profile of the strip.
Figure 4:
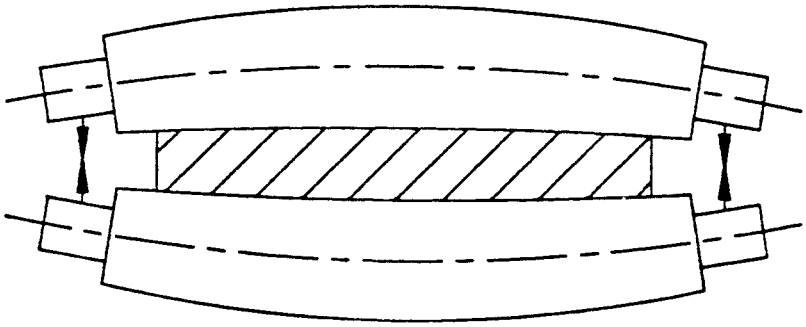
FIG. 4 (PRIOR ART)
FIG. 4 is a simplified elevational view, partly in cross section, illustrating a pair of prior art crowned rolls utilizing roll bending controls to bend the roll ends toward the strip, and the resulting strip profile.

Clearly the distribution of the crown components among the rolls is unimportant, and any such distribution should fall within the spirit of my invention. The essential feature of my invention is that a flared roll profile component of the form 27 shown in FIG. 11 is included on one or some of the rolls in a cold rolling mill, (such rolls having base profiles which are either cylindrical or crowned) which also has one or some rolls having a prior art crowned profile of the form 22 shown in FIG. 2 or form 26 shown in FIGS. 8 and 10. The novel feature of the profile of FIG. 11 is that it is generally concave in shape, with the roll ends larger in diameter than the roll middle, and it has a central portion which is flat, or cylindrical in form, which blends smoothly into tapered concave portions of gradually increasing diameter at each end of the roll face.

Figure 13:
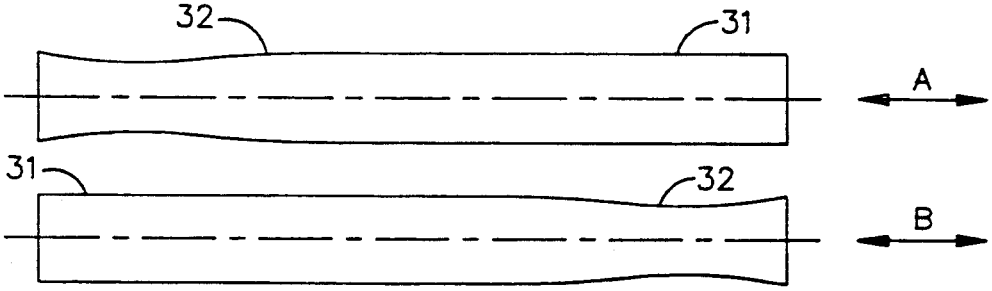
FIG. 13 is a simplified cross sectional view of a pair of work rolls according to another embodiment of the present invention.
Figure 14:
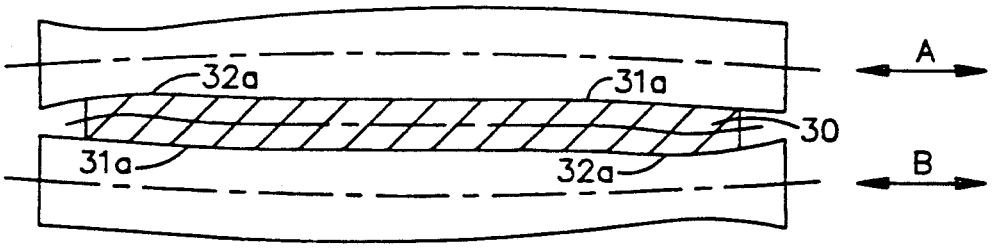
FIG. 14 is a simplified elevational view, partly in cross section, illustrating the rolls of FIG. 13 in deflected condition and the resulting strip profile..

In FIG. 13 there is shown a skew-symmetrical embodiment of the invention. In this case, a longitudinal half of each roll is cylindrical in form, (profile 31) and the other longitudinal half has a profile 32 which is identical in form to half the width of profile 25 of FIGS. 8 or 10. The rolls are arranged in skew-symmetry (i.e. one roll is reversed end-for-end with respect to the other roll). FIG. 14 shows the effect of rolling strip 30 with this arrangement, the deflected profiles 31 and 32 being indicated at 31*a* and 32*a*, respectively. It can be seen that, apart from the skew-symmetric flexure of the strip, the strip profile is identical to the ideal strip profile 21 shown in FIGS. 5 and 9.

The advantage of the arrangement of FIG. 13 is that, by providing axial adjustment of the two rolls (indicated by arrows A and B), it is possible to adjust the profile to suit various strip widths and separating force levels. In this way the method of the present invention can be used in combination with prior art methods of adjusting the profile of the rolled strip.

Figure 15:
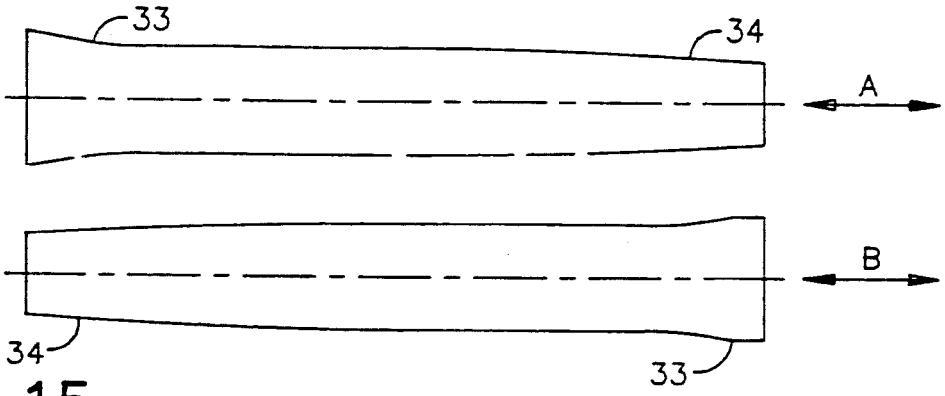
FIG. 15 is a simplified elevational view of yet another embodiment of work rolls of the present invention.

In FIG. 15 there is shown another skew-symmetrical embodiment of the present invention. In this case one longitudinal half of each roll face has a profile 34 which is identical to half the base profile 26 of the roll of FIG. 10. The other longitudinal half of each roll face has a profile 33 which is identical to half the profile 29 of the roll of FIG. 11. This embodiment is functionally identical to the embodiment of FIG. 13, as can be readily understood from the foregoing.

Figure 16:
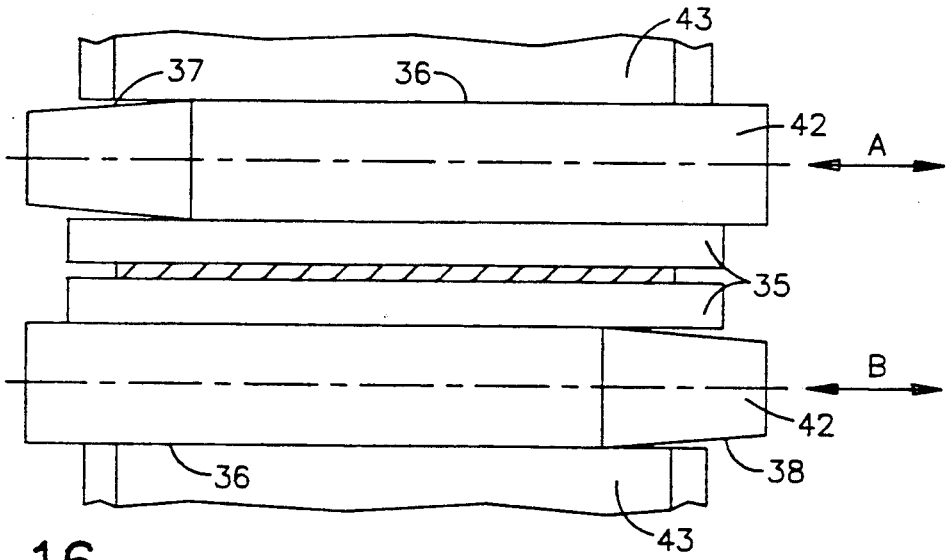
FIG. 16 (PRIOR ART)
FIG. 16 is a fragmentary, simplified elevational view, partly in cross section, of a prior art 6-high mill.

FIG. 16 illustrates the roll arrangement on prior art 6-high rolling mills. As is well known in the art, such mills have work rolls 35 supported by intermediate rolls 42, which are, in turn, supported by back-up rolls 43. In general, on such mills the work rolls 35 and back-up rolls 43 will have either a cylindrical or a prior art crowned profile such as profile 22 of FIG. 5. Intermediate rolls are arranged skew-symmetrically, with a profile consisting of a main cylindrical portion 36, and tapered portion. The tapered portion of the intermediate roll is generally either of a linear (conical) form (as shown at 37 on the upper roll) or of a smooth convex form which blends more smoothly into the cylindrical portion (as shown at 38 on the lower roll). The intermediate rolls 42 are axially shiftable as indicated by arrows A and B.

Such prior art rolling mill arrangements tend to produce strip having quarter buckle when the incoming strip has the characteristic profile shown in FIG. 5 ("edge drop" profile). It is proposed to improve the performance of such mills by providing the same concave profiled flared portions as before, an arrangement according to this embodiment being shown in FIG. 17.

Figure 17:
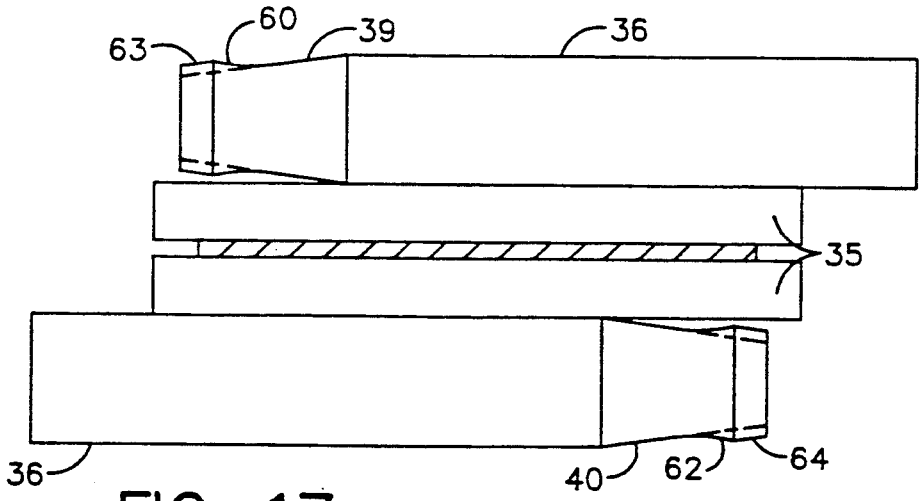
FIG. 17 is a simplified elevational view, similar to FIG. 16, illustrating the use of intermediate rolls configured according to the present invention.

In FIG. 17 the roll arrangement is similar to that of FIG. 16, but the tapered portions of the intermediate rolls are provided with the concave profiled flared portions. As before, the start of the taper may be linear or convex in form. In FIG. 17 there is shown a linear form 39 for the start of the taper on the upper intermediate roll. This blends into a concave profiled flared portion 60. On the lower intermediate roll of FIG. 17 there is shown a convex form 61 for the start of the taper on the lower intermediate roll. This blends into a concave profiled flared portion 62.

For mills such as 6-high mills where the profiled rolls are backed up by other rolls, it is important to avoid excessive contact beyond the edges of the strip between the profiled roll and the support roll. Therefore, flares 60 and 62 are truncated, and portion 63 of the upper roll has the same profile as portion 39, but at an increased diameter; portion 64 has the same profile as portion 40, but at an increased diameter.

It will be readily understood that, in the same way that the base profile 26 of the roll of FIG. 8 is of higher magnitude than the prior art profile 22 of the roll that the roll of FIG. 8 would replace, the steepness of the tapers 39 and 40 of the roll of FIG. 17 would be greater than the steepness of the tapers 37 and 38 which they replace.

The arrangement of the embodiment of FIG. 17 is capable of rolling strip having the characteristic "edge drop" profile 21 shown in FIG. 5, unlike the prior art arrangement of FIG. 16, which tends to produce quarter buckles when rolling such strip, regardless of the magnitude of the tapers, or whether they are linear or convex.

Figure 18:
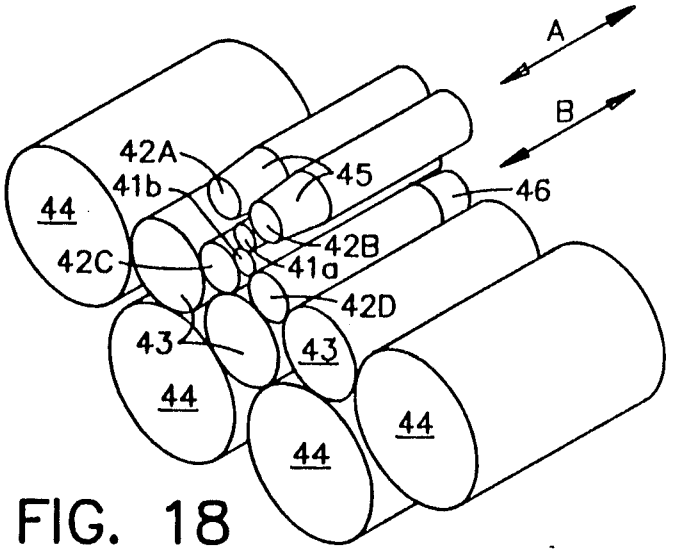
FIG. 18 (PRIOR ART)
FIG. 18 is a partial isometric view of a prior art 20-high cluster mill roll arrangement.

In FIG. 18 there is shown a partial isometric view of a prior art 20-high cluster mill roll arrangement, of the general type described in U.S. Pat. No. 2,776,586. In such a mill work rolls 41A and 41B, which are usually cylindrical or provided with a small crown (i.e. convex profile), are supported by first intermediate rolls 42A–42D, the upper work roll 41A being supported by first intermediate rolls 42A and 42B, and the lower work roll 41B being supported by first intermediate rolls 42C and 42D. The mill is also provided with second intermediate rolls 43 and back-up rolls 44 at top and bottom.

The upper first intermediate rolls 42A, 42B are provided with tapers 45 at one end, and the lower first intermediate rolls 42C, 42D are provided with tapers 46 at the other end. By axial adjustment of upper and lower first intermediate rolls (indicated by arrows A and B) the profile of the mill can be adjusted in a similar manner to that shown in FIG. 16 for a 6-high mill.

It should be noted that the upper two first intermediate rolls 42A, 42B are moved axially by a common adjustment mechanism, so that they move in an axial direction together, and cannot be adjusted independently. The lower two first intermediate rolls 42C, 42D are similarly linked and moved together.

In the case of such 20-high rolling mills, the present invention now provides independent axial adjustment of all four first intermediate rolls 42A, 42B, 42C and 42D in another embodiment of the invention. One upper roll will be provided with a taper at one end similar to portion 37 of FIG. 16. The second upper roll will be provided with a truncated flared profile at the same end similar to the right hand half of the profile 29 of FIG. 11. One lower roll will be provided with a taper at the opposite end similar to portion 38 of FIG. 16. The second lower roll will be provided at the same opposite end with a truncated flared profile similar to the right hand half of the profile 27 of FIG. 11.

Note that the tapers may be either conical or parabolic or any such convenient form and profiles 48 and 50 may be either full or truncated without departing from the spirit of the invention.

Figure 19:
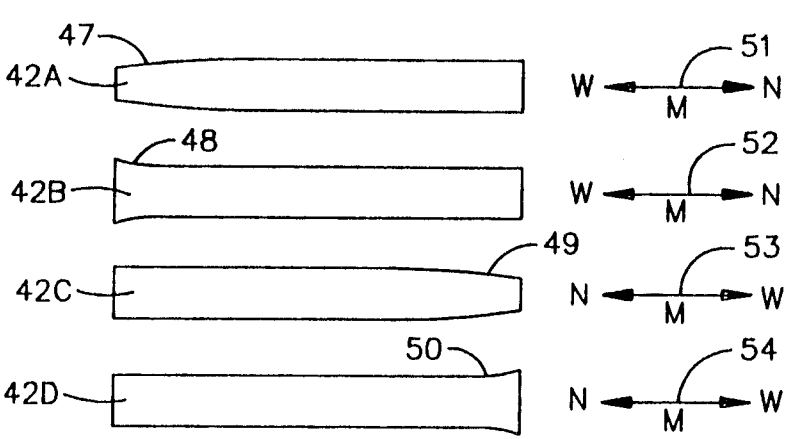
FIG. 19 is a simplified elevational view of first intermediate rolls, according to the present invention, for use in the roll arrangement of FIG. 18.

FIG. 19 illustrates the profiles of the four first intermediate rolls of this embodiment. Roll 42A is provided with tapered relief 47 at the first end, and roll 42B is provided with a flared portion 48 at the same (first) end. Roll 42C is provided with a tapered relief 49 at the second end, and roll 42D is provided with a flared portion 50 at the same (second) end. The profiles of all four rolls are cylindrical apart from the tapered reliefs or flared portions.

In FIG. 19 the arrows 51–54 denote the four independent lateral adjustment drive systems used to adjust the four rolls. W denotes wider setting (relative to width of strip being rolled), N denotes narrower setting and M denotes middle setting.

Figure 20:
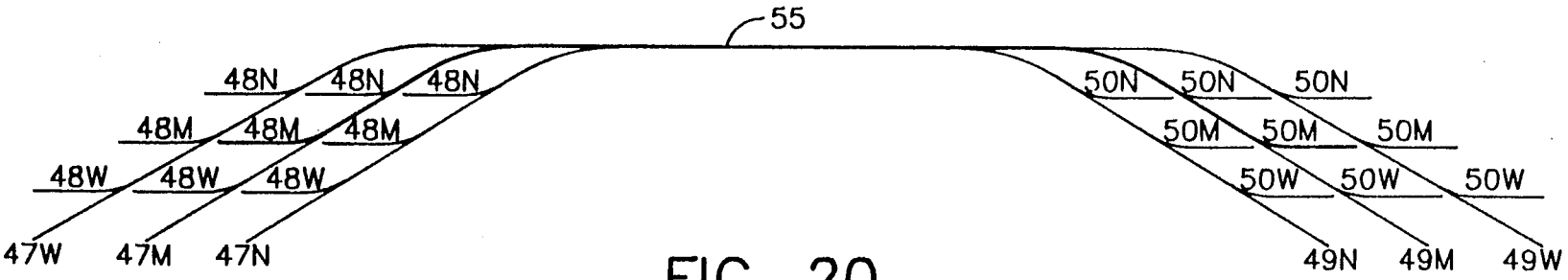
FIG. 20 is a diagrammatic representation of the effect upon the mill profile of the axial shifting of the rolls of FIG. 19.

FIG. 20 shows the effect upon the mill profile of axial shifting of the respective rolls, and hence shifting of the respective tapered reliefs or flared portions. N, M and W have the same meanings as before. The heavy curve 55 represents the mill profile which would be achieved with all adjustments at their mid-positions.

It can be seen from FIG. 20 that a wide variety of mill profiles can be achieved by the use of the roll profiles with four independent adjustment systems used in this embodiment. Axial shifting of rolls 42A and 42C, which shifts profiles 47 and 49, governs the profile of the strip in the area of the quarter bands, or just inside the strip edges. Axial shifting of rolls 42B and 42D governs the profile of the strip at the edges by shifting flared profiles 48 and 50.

It should be noted that all the figures show exaggerated roll profiles (i.e. exaggerated vertical scale), and that this has been done for the purpose of clarity. Actual variations in diameter along the length of a given roll will generally be of the order of several thousandths of an inch, and so would not be visible in the drawings had the profiles been drawn to scale. In most cases, truncation of flares has been omitted for the sake of clarity.

It will be understood that the provisions of the flared profile portions close to the ends of the roll will not necessarily increase the overall diameter of the roll. It must be remembered that the flared profile portions increase the roll diameter only with respect to those portions of the base profile they replace.

Modifications may be made in the invention without departing from the spirit of it.

What is claimed is:

1. A roll for use in a rolling mill for cold rolling metal strip possessing edge drop, said roll having a diameter and a base profile chosen from a class consisting of partly crowned=partly cylindrical and partly cylindrical=partly tapered, said partly crowned and partly cylindrical base profile, at one end, only, blending smoothly into a flared portion, said partly cylindrical and partly tapered base profile, at its tapered end only, blending smoothly into a flared portion, each flared portion increasing the roll diameter with respect to the base profile it replaces.

2. The roll claimed in claim 1 wherein said roll has a longitudinal half of cylindrical profile and a longitudinal half of crowned profile, said last mentioned half terminating near an end of said rolls in said flared portion.

3. The roll claimed in claim 1 wherein said roll has a longitudinal half of crowned profile and a longitudinal half of cylindrical profile, said last mentioned longitudinal half terminating near an end of said roll in said flared portion.

4. The roll claimed in claim 1 wherein said roll has a base profile comprising a main cylindrical portion leading to a tapered portion near one end, said tapered portion having one of a linear and a convex taper, said tapered portion terminating in said flared portion.

5. The roll claimed in claim 4 wherein said flared portion is truncated at a point adjacent to an edge of said strip to be rolled.

6. The roll claimed in claim 1 including a cold rolling mill having first and second work rolls, said roll comprising said first work roll and having a longitudinal half of cylindrical profile and a longitudinal half of crowned profile, said last mentioned longitudinal half terminating near an end of said roll in said flared portion, said second work roll having the same profile as said first work roll, said first and second work rolls being arranged in skew-symmetry.

7. The roll claimed in claim 6 wherein said first and second work rolls are independently axially shiftable.

8. The roll claimed in claim 1 including a cold rolling mill having first and second work rolls, said roll comprising said first work roll and having a longitudinal half of crowned profile and a longitudinal half of cylindrical profile, said last mentioned longitudinal half terminating near an end of said roll in said flared portion, said second work roll having the same profile as said first work roll, said first and second work rolls being arranged in skew-symmetry.

9. The roll claimed in claim 8 wherein said first and second work rolls are independently axially shiftable.

10. The roll claimed in claim 1 including a 6-high cold rolling mill having first and second work rolls, first and second intermediate rolls and first and second back-up rolls, said back-up and work rolls having profiles chosen from a class consisting of cylindrical profiles and crowned profiles, said roll comprising said first intermediate roll and having a base profile comprising a main cylindrical portion leading to a tapered portion near one end, said tapered portion having one of a linear and a convex taper, said tapered portion terminating in said flared portion, said second intermediate roll having the same profile as said first intermediate roll, said first and second intermediate rolls being arranged in skew-symmetry.

11. The roll claimed in claim 10 wherein said first and second intermediate rolls are independently axially shiftable.

12. The roll claimed in claim 10 wherein said flared portions of said first and second intermediate rolls are truncated at a point adjacent to edges of said strip to be rolled.

13. A roll for use in a rolling mill for cold rolling metal strip possessing edge drop, including a 20-high cold rolling mill having a pair of work rolls, two upper and two lower first intermediate rolls, three upper and three lower second intermediate rolls, and four upper and four lower back-up rolls, said roll comprises one of said upper first intermediate rolls, said roll having a diameter and a cylindrical base profile, at one end only, blending smoothly into and terminating at said end in a flared portion, said flared portion increasing the roll diameter with respect to that part of said base profile it replaces, the other of said upper first intermediate rolls having a cylindrical base profile terminating in a linear or convex tapered portion at an end corresponding to said flared portion of said one upper first intermediate roll, said lower first intermediate rolls having the same profiles as said upper first intermediate rolls respectively and being arranged in skew-symmetry with respect thereto, each of said upper and lower first intermediate rolls being independently axially shiftable.

14. A method of cold rolling metal strip possessing edge drop comprising the steps of providing a cold rolling mill having at least two rolls, providing at least one of said rolls with a diameter and a base profile chosen from a class consisting of partly crowned=-partly cylindrical and partly cylindrical=partly tapered, said partly crowned and partly cylindrical base profile, at one end only, blending smoothly into a flared portion, said partly cylindrical and partly tapered base profile, at its tapered end only, blending smoothly into a flared portion, said flared portion increasing the roll diameter with respect to the base profile it replaces.

15. The method claimed in claim 14 wherein said at least one roll comprises a first work roll having a base profile which is cylindrical for one longitudinal half of said last mentioned roll and crowned for the other longitudinal half of said last mentioned roll, said flare being provided at one end of said last mentioned roll, and including the steps of providing a second work roll of the same overall profile of said first work roll, arranging said first and second work rolls in skew-symmetry, shifting and first and second work rolls axially to adjust the roll gap profile, and causing said metal strip to pass between said first and second work rolls.

16. The method claimed in claim 14 wherein said mill comprises a 6-high mill having first and second work rolls, first and second intermediate rolls and first and second back-up rolls said work and back-up rolls having profiles chosen from the class consisting of cylindrical profiles and crowned profiles, said at least one roll comprising said first intermediate roll, and including the steps of providing said first intermediate roll with a base profile comprising a main cylindrical portion leading to a tapered portion near one end terminating in said flared portion, providing said second intermediate roll with the same overall profile of said first intermediate roll, arranging said first and second intermediate rolls in skew-symmetry and adjusting them axially to adjust the work roll gap profile, and causing said metal strip to pass between said first and second work rolls.

17. The method claimed in claim 14 wherein said mill comprises a 20-high mill having a pair of work rolls, two upper and two lower first intermediate rolls, three upper and three lower second intermediate rolls, and four upper and four lower back-up rolls, said at least one roll comprising one of said upper first intermediate rolls, and including the steps of providing said at least one roll with a cylindrical base profile terminating at one end in said flared portion, providing the other of said upper first intermediate rolls with a cylindrical base profile terminating in a linear or convex tapered portion at an end corresponding to said flared portion on said at least one roll, providing said lower first intermediate rolls with the same profiles as said upper intermediate rolls respectively and arranging them in skew-symmetry with respect thereto, adjusting each of said upper and lower first intermediate rolls axially to adjust a work roll gap profile, and causing said metal strip to pass between said pair of work rolls.

* * * * *

UNITED STATES PATENT AND TRADEMARK OFFICE

CERTIFICATE OF CORRECTION

PATENT NO. : 5,131,252

DATED : 7/21/92

INVENTOR(S) : John W. Turley, et al

It is certified that error appears in the above-indentified patent and that said Letters Patent is hereby corrected as shown below:

Column 12, claim 15, line 15, "and" should be deleted and replaced with --said--.

Signed and Sealed this

Twenty-eighth Day of September, 1993

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,131,252

DATED : July 21, 1992

INVENTOR(S) : John W. Turley et al

It is certified that error appears in the above-indentified patent and that said Letters Patent is hereby corrected as shown below:

Column 10, line 26, claim 1, "crowned=partly" should be deleted and replaced with --crowned-partly --.

Column 10, lines 26 and 27, "partly cylindrical=partly tapered," should be deleted and replaced with --partly cylindrical-partly tapered --.

Column 11, line 51, claim 14, "cylindrical=partly" should be deleted and replaced with --cylindrical-partly --.

Column 11, line 52, claim 14, "cylindrical=partly" should be deleted and replaced with --cylindrical-partly --.

Column 12, line 15, claim 15, "and" should be deleted and replaced with -- said --.

This Certificate supersedes Certificate of Correction issued September 28, 1993.

Signed and Sealed this

Twenty-eighth Day of December, 1993

*Attest:*

Bruce Lehman

BRUCE LEHMAN

*Attesting Officer*

*Commissioner of Patents and Trademarks*